US006793800B2

(12) United States Patent
Whitmore

(10) Patent No.: US 6,793,800 B2
(45) Date of Patent: Sep. 21, 2004

(54) CATHODIC PROTECTION OF STEEL WITHIN A COVERING MATERIAL

(76) Inventor: David Whitmore, 38 Kings Dr., Winnipeg, Manitoba (CA), R3T 3E5

( * ) Notice: Subject to any disclaimer, the term of this patent is extended or adjusted under 35 U.S.C. 154(b) by 0 days.

(21) Appl. No.: 10/324,111

(22) Filed: Dec. 20, 2002

(65) Prior Publication Data

US 2004/0118702 A1 Jun. 24, 2004

(51) Int. Cl.[7] ..... C23F 13/00

(52) U.S. Cl. ..... 205/734; 205/730; 205/731; 205/732; 205/733

(58) Field of Search ..... 429/734, 730, 429/731, 732, 733

(56) References Cited

U.S. PATENT DOCUMENTS 6,193,857 B1 2/2001 Davision et al. ..... 204/196.01
6,303,017 B1 * 10/2001 Page et al. ..... 205/734

FOREIGN PATENT DOCUMENTS

WO WO 94/29496 12/1994
WO WO 00/46422 8/2000

* cited by examiner

*Primary Examiner*—Bruce F. Bell
(74) *Attorney, Agent, or Firm*—Adrian D. Battison; Michael R. Williams; Ryan W. Dupuis

(57) ABSTRACT

Cathodic protection of an existing concrete structure, including a steel member at least partly buried, such as steel rebar, in the concrete structure, is provided by embedding anodes into a fresh concrete layer applied over an excavated patch and/or as a covering overlay. The anodes are embedded at spaced positions or as an array in the layer and connected to the rebar. A corrosion inhibitor is added into the fresh concrete at least at the interface and more preferably in admixture with the fresh concrete which acts to reduce the flow of ionic current to the steel or between the anode member and the steel in the fresh covering material without significantly increasing the resistivity of the fresh covering material and without inhibiting the ionic current between the anode member and the fresh covering material. In this way the current to the steel in the existing concrete is maximized to maximize the cathodic protection to the existing steel which is the primary target.

41 Claims, 8 Drawing Sheets

CATHODIC PROTECTION OF STEEL WITHIN A COVERING MATERIAL

This invention relates to a method for cathodic protection, which is particularly but not exclusively arranged for use with steel reinforced concrete structure, wherein the structure includes an existing portion having part of the steel elements embedded therein and a fresh portion having part of the steel elements embedded therein.

BACKGROUND OF THE INVENTION

Cathodic protection of steel elements at least partly embedded in a surrounding layer is well known and one method for this purpose is described in PCT Application CA00/00101 filed 2$^{nd}$ Feb. 2000 and published as WO 00/46422 by the present inventor.

In PCT Published Application WO 94/29496 of Aston Material Services Limited is provided a method for cathodically protecting reinforcing members in concrete using a sacrificial anode such as zinc or zinc alloy. In this published application and in the commercially available product arising from the application, there is provided a puck-shaped anode body which has a coupling wire attached thereto. In the commercially available product there are in fact two such wires arranged diametrically opposed on the puck and extending outwardly therefrom as a flexible connection wire for attachment to an exposed steel reinforcement member.

The puck is surrounded by an encapsulating material such as mortar which holds an electrolyte that will sustain the activity of the anode. The mortar is compatible with the concrete so that electrolytic action can occur through the mortar into and through the concrete between the anode and the steel reinforcing member.

The main feature of the published application relates to the incorporation into the mortar of a component which will maintain the pH of the electrolyte in the area surrounding the anode at a high level of the order of 12 to 14.

In use of the device, a series of the anodes is provided with the anodes connected at spaced locations to the reinforcing members. The attachment by the coupling wire is a simple wrapping of the wire around the reinforcing bar. The anodes are placed in locations adjacent to the reinforcing bars and re-covered with concrete to the required amount.

Generally this protection system is used for concrete structures which have been in place for some years sufficient for corrosion to start. In general, areas of damage where restoration is required are excavated to expose the reinforcing bars whereupon the protection devices in the form of the mortar-covered pucks are inserted into the concrete as described above and the concrete refilled.

These devices are beginning to achieve some commercial success and are presently being used in restoration processes. However improvements in operation and ergonomics are required to improve success of this product in the field.

U.S. Pat. No. 6,193,857 (Davison) assigned to Foseco discloses an anode body in the form of a puck coated with a mortar in which the puck is attached by ductile wires to the rebar within an excavation in the concrete.

The present invention relates to such concrete structures where an existing structural portion is repaired or covered with a fresh portion of concrete. Thus in some cases, the fresh portion may be applied to an excavated patch where existing steel is exposed and covered by fresh concrete. In this case additional steel may or may not be applied into the fresh concrete, depending upon whether the existing steel has deteriorated to where it requires to be supplemented and depending upon the engineering requirements for the completed structure. In other cases, the existing structure may be supplemented by an overlay or covering which is applied onto the underlying concrete without the necessity for excavation. In this case, additional steel may be in some cases applied into the overlay so that the existing steel in the existing concrete remains in place and the new steel in the new concrete is added to provide the engineering requirements for the complete structure.

In some cases it is known, both in an original concrete structure as constructed and in any repairs thereto, to apply a coating such as an epoxy to the steel rebar so as to reduce the corrosion of the steel, primarily by reducing the ionic current between the steel and the concrete. However this is counter-productive in the cathodic protection method, in that the intention is to provide an ionic current between the anode and the steel (generated by the galvanic action between the steel and the anode member) which minimizes corrosion of the steel.

In some cases it is known to apply a material of the type known as a corrosion inhibitor to a concrete so as to reduce the corrosion of the steel therein, again by reducing or preventing the ionic current between the steel and the concrete. However this would be entirely counter-productive in the cathodic protection method, in that the intention is to provide an ionic current between the anode and the steel (generated by the galvanic action between the steel and the anode member) which minimizes corrosion of the steel, and the presence of the corrosion inhibitor would interfere with this ability.

SUMMARY OF THE INVENTION

It is one object of the present invention, therefore, to provide an improved method of cathodic protection of steel within a covering where the steel is protected by providing an anode material in or in contact with the covering material which provides an ionic current to the steel through the covering material.

According to a first aspect of the invention, therefore, there is provided a method for cathodic protection comprising:

- providing steel material;
- applying a covering material such that a part of the steel material is at least partly covered by the covering material;
- forming a cathodic protection combination by:
  - providing at least one anode member;
  - arranging the at least one anode member in connection with the covering material for communication of ions therebetween;
  - and electrically connecting the at least one anode member so that an electrical potential between the anode member and the steel material causes ions to flow through the covering material tending to inhibit corrosion of the steel material;
  - and applying into the combination a corrosion inhibiting material.

According to a second aspect of the invention, therefore, there is provided a method for cathodic protection comprising:

- providing an existing structure including an existing covering material;
- providing steel material;
- applying a fresh covering material to the existing structure such that a part of the steel material is at least partly covered by the existing covering material and a part of the steel material is at least partly covered by the fresh covering material;

providing at least one anode member;

arranging the at least one anode member in connection with the fresh covering material for communication of ions therebetween;

electrically connecting the at least one anode member so that an electrical potential between the anode body and the steel material causes ions to flow through the covering material tending to inhibit corrosion of the steel material;

and increasing the flow of ionic current between the anode member and the steel material within the existing covering material to provide increased protection for the steel material in the existing covering material by reducing the flow of ionic current between the anode member and the steel material within the fresh covering material.

The invention is primarily concerned with galvanic systems in which the anode body is formed from a sacrificial material which corrodes relative to the steel material without the provision of impressed current. The invention is beneficial since the generation of sufficient current to adequately protect the reinforcing steel over a long life in such systems is difficult to achieve. However the same principles as set out herein can also be used in impressed current systems.

The invention is applicable primarily but not exclusively to repairs where an existing structure has fresh covering material added.

The invention is applicable both to repairs where some of the existing covering material is excavated to expose the existing steel and the fresh covering material is applied over the exposed steel, to overlays or new structures where the steel within the fresh covering material is wholly new steel and to arrangements which include both a repair or patch and an overlay.

The term "steel material" as used above is intended to refer generally to any steel component or components which are in contact with the covering material in a manner such that corrosion can occur. The term is used to maintain generality as to the number and type of components within the fresh material and/or the existing material. Such components may be wholly or only partly buried within the covering material. The term may relate to steel reinforcing elements or bars within the covering material, to steel elements within the covering material which are structural and to steel elements within the covering material which are non-structural and non-reinforcing but which can corrode. In many cases the steel material is in the form of a plurality of steel elements, generally reinforcing bars, some of which are in the fresh material and some in the existing material. However the term is intended also to cover arrangement wherein a single element such as a beam extends both into the fresh material and the original or existing material.

While the present invention is primarily concerned with concrete as the covering material, it will be appreciated that it is not so limited and other materials which allow the communication of ions to the reinforcing steel can also require to be protected in this manner.

The existing covering material and the fresh covering material are in most cases the same material and in most cases concrete, but it will be appreciated that the fresh material need not be the same as the original material provided both cooperate with the steel in a galvanic action with the anode members and provided there is communication of ions through the interface between the existing and the fresh materials.

In many cases, the anode member or members are wholly buried or embedded within the covering material. However the anode members may be partially embedded or even located on the surface of the fresh concrete provided they are in ionic communication with the steel in the structure.

Preferably the flow of ionic current between the anode member and the steel material within the fresh covering material is reduced by providing a material which interferes with the communication of ionic current through the interface between the fresh covering material and the steel material therein In one arrangement, the material can be applied onto the at least one steel element within the fresh covering material as a coating thereon.

In an alternative arrangement, the material can be applied into the fresh covering material at the interface with the steel material therein. In this case, the material is preferably applied into the fresh covering material in admixture therewith, but it also may be applied as an admixture with a small portion of the fresh covering material initially applied over the steel or as a material which remains at the interface.

In a further alternative, the material is carried by the anode member when it is embedded in the covering material for diffusion from the anode member into the covering material.

Where the material is applied into or with the covering material, it is preferably of a character which is a corrosion inhibitor.

Such corrosion inhibitors may be selected from the group consisting of aliphatic and aromatic nitrogen compounds and aliphatic and aromatic phosphorous compounds.

Preferably the material is of a character which avoids inhibiting the ability of the anode to generate an ionic current between the anode member and the covering material Preferably the material is of a character which avoids significantly increasing the resistivity of the concrete as this would reduce the ability of the anode to pass ionic current to the steel material.

This method is particularly advantageous where the anode body is formed at least partly of finely divided materials which are pressed together and where the anode body includes admixed therewith an enhancement material for co-operating with the sacrificial anode material in enhancing the communication of ions between the covering layer and the anode material, which material is bound into the sacrificial anode material of the solid anode body so as to be carried thereby.

The anode member may advantageously comprises an electrically conductive array which is at least partly formed by said anode material.

According to a third aspect of the invention there is provided a method for cathodic protection comprising:

providing an existing structure including an existing covering material;

providing steel material;

applying a fresh covering material to the existing structure such that at least part of the steel material is at least partly covered by the existing covering material and at least part of the steel material is at least partly covered by the fresh covering material;

providing at least one anode member;

arranging the at least one anode member in connection with the fresh covering material for communication of ions therebetween;

electrically connecting the at least one anode member so that an electrical potential between the anode body and the steel material causes ions to flow through the covering material tending to inhibit corrosion of the steel material;

and applying into the fresh covering material at least at the interface with the steel material therein a material of a character which reduces the flow of ionic current between the steel material and the fresh covering material without substantially increasing the resistivity of the fresh covering material and without substantially inhibiting the flow of ionic current between the anode member and the fresh covering material.

The material applied within the fresh covering material thus increases the proportion or ratio of current flowing to the existing steel material. It may or may not decrease the total ionic current due to the reduction of current to the steel material in the fresh covering material. There is, due to the increase in the proportion or ratio, however a net tendency to increase the cathodic protection to the existing steel where it is primarily required.

BRIEF DESCRIPTION OF THE DRAWINGS

Embodiments of the invention will now be described in conjunction with the accompanying drawings, in which.

DETAILED DESCRIPTION

Attention is directed to the disclosure in the above PCT Application by the present inventor which discloses the manufacture and use of anode bodies including anode materials, enhancement materials and methods of installation. The present embodiments disclosed herein include and use many of the constructions, arrangements and enhancement materials described therein.

Figure 1:
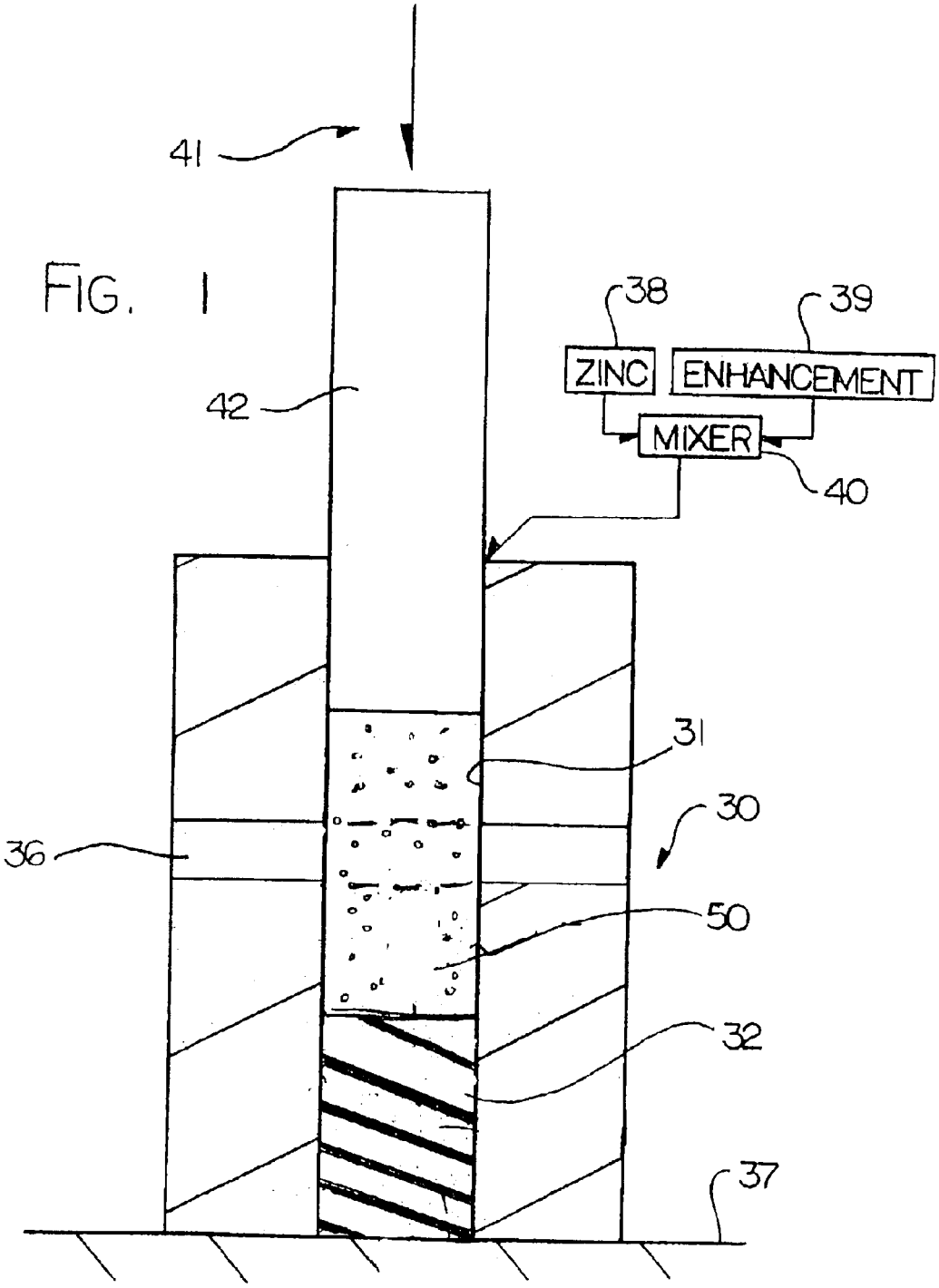
FIG. 1 is a schematic illustration of a method for forming an anode body for use in the method of the present invention.

Turning now to the anode bodies used herein, attention is directed to FIG. 1 which shows one example of a method for manufacturing the anode bodies of the types shown for example in FIGS. 2 to 8.

The enhancement materials and the sacrificial anode material, such as zinc, can be pressed together to form a porous body as shown in FIG. 1.

In FIG. 1 is shown schematically the method for forming the anode body. This comprises a form or mold 30 which defines a hollow interior 31 which is generally cylindrical. At a forward end of the form is provided an end face member 32 which is shaped to match the required shape of the forward end of the body. In one example (not shown) this may be conical so as to match that of the intended drilled hole, if the anode body is intended for use with a drilled hole, but may also be of other shapes including flat forward end as shown, as required for the intended end use.

A steel wire or steel rod 36 is inserted into the hollow interior of the chamber transversely to the bore 31. Thus the wire or rod extends across the hollow interior to define a rod which will form a central core of the anode body. The rod or wire is preferably formed of steel so as to provide a suitable electrical connection to the steel of the reinforcement of the concrete.

The zinc particles to form the anode body are mixed with the enhancement material from suitable supplies 38 and 39 within a mixer 40 which is then inserted into a open upper end of the chamber 31. A suitable compression system schematically indicated at 41 is provided so as to apply pressure from a ram 42 onto the mixed materials within the chamber 31. The pressure is thus applied vertically downwardly onto the particulate materials within the chamber applying a compressive action onto the mixed materials sufficient to integrate the structure into the required anode body.

Preferably the anode body is formed simply by pressure on the particulate materials and typically pressures to effect sufficient compaction to maintain an integral structure will be in the range 5,000 psi to 40,000 psi. Heat is therefore preferably not used but can be used to effect a melting of the particles at the points of engagement to enhance structural integrity. However heat can damage many enhancement materials and hence is difficult to use and may require a vacuum to prevent combustion.

The zinc particles can be supplied in the form of powder having a size in the range 325 mesh (that is particles which will pass through a 325 mesh) to 0.25 mm. The particulate materials can be wholly powder but preferably contain a proportion of shavings, fibers or flakes which have increased dimension in one or two directions. Thus fibers may have dimensions of the order of 1 mm to 6 mm in the length direction and a transverse dimension of the order of 0.1 mm. Flakes may have dimensions of the order of 1 mm to 6 mm in the longer directions and a thickness of the order of 0.1 mm. Such shavings, fibers or flakes are commercially available from a number of suppliers. It will be appreciated that the use of particles having increased dimensions in one or two directions increases the mechanical interconnection between the particles thus providing an increased structural strength and an increased structural integrity. The anode body can be formed wholly of such shavings, fibers or flakes. However the cost of this structure of zinc particles is significantly higher than simple powder and hence it is highly desirable to provide an economic balance based upon selecting lower cost powder materials with a suitable proportion of higher cost shavings to provide the required structural integrity and pore dimensions. Typically shavings might form a 20% proportion of the total volume of the zinc particles.

The enhancement material is preferably particulate having a particle size in the range 0.1 mm to 1 mm and is preferably in crystalline form. However other forms of the enhancement material might be used including powder or a pellet form having a significantly greater dimension up to 8 mm. The use of the larger pellets provides improved physical properties in that there is greater particle-to-particle contact between the zinc particles than can be obtained using smaller particles in powder form. This is achieved because there are reduced number of pellets which are thus located in specific smaller number of locations within the zinc particles thus allowing improved contact between the zinc particles themselves. However it is also a requirement that the enhancement material be spread throughout the zinc so that there also a requirement or a desirability to ensure that the areas of enhancement material are not so isolated from all of the zinc so that the enhancement can not properly occur. Thus a balance must be selected between particle size to ensure that the enhancement operates effectively during the life of the zinc anode while obtaining a suitable structural integrity. Either the powder or pellets of the above dimensions have been found to operate satisfactorily.

The ratio of the zinc particles to the enhancement particles is preferably of the order of 60% zinc particles by volume. However the zinc content may range from 30% to 95% by volume.

Using the above typical pressures, using metal particles of the above dimensions and using the enhancement materials as defined above, the total volume of void within the finished anode body is typically of the order of 5% to 40%. The anode body can be formed without any enhancement materials so that it is formed wholly (100%) of the zinc particles defining the pores within the metal body. In such an arrangement it is preferable to have a higher level of void so as to provide sufficient void volume to absorb the corrosion products during the life of the corrosion of the zinc anode body.

In an arrangement where enhancement material is used, it will be appreciated that the compression of the zinc particles forms a series of pores within the zinc structure, some of which are empty so as to form voids, some of which are wholly filled by the enhancement material, and some of which are partly filed with the enhancement material. When the enhancement material is used, some of the voids which are partly or wholly filled with the enhancement material can become available to absorb the corrosion products. Thus in such a case there is the possibility to reduce the total void volume. Thus in other words some of the enhancement material is utilized in the corrosion process and thus makes available its space previously occupied for the receipt of corrosion products. Yet further, some of the enhancement materials may be soluble so that they may gradually defuse out of the anode body leaving their original space available for the corrosion products.

Yet further some enhancement materials, such as lithium hydroxide or calcium chloride, have the advantage that they render the corrosion products more soluble so that the corrosion products themselves may diffuse in solution out of the anode body into the surrounding concrete. Thus it is still required to provide the pores of the present invention so that absorption of corrosion products can occur but the total volume of pores required may be reduced relative to the total volume of corrosion products in view of this diffusion of the corrosion products during the life of the process.

During the life of the process, typical expansion of the volume of the anode body in view of the corrosion products can be achieved in the range 20 to 30 percent, but can be much higher in some cases and particularly when using magnesium or other materials. Thus it is theoretically necessary to absorb into the anode body itself this expansion of 20 to 30 percent. However in view of the above factors it is not necessary in all cases to provide a volume of void space within the anode body equal to the anticipated expansion. The use of the enhancement material within the anode body itself provides the advantages of making available the above additional void space and the possible advantage of rendering more soluble the corrosion products. However it is not essential to provide the enhancement material within the anode body itself since it is possible to provide the enhancement material in a mortar or filler surrounding the anode body. In yet other cases the enhancement material may be omitted since advantage can be obtained simply by using the porous anode body set forth above without any enhancement material.

The humectant material or other enhancement material, if used, is thus selected so that it remains supported by and admixed into the anode or material surrounding the anode so that it does not significantly migrate out of the anode body during storage or in use.

Figure 2:
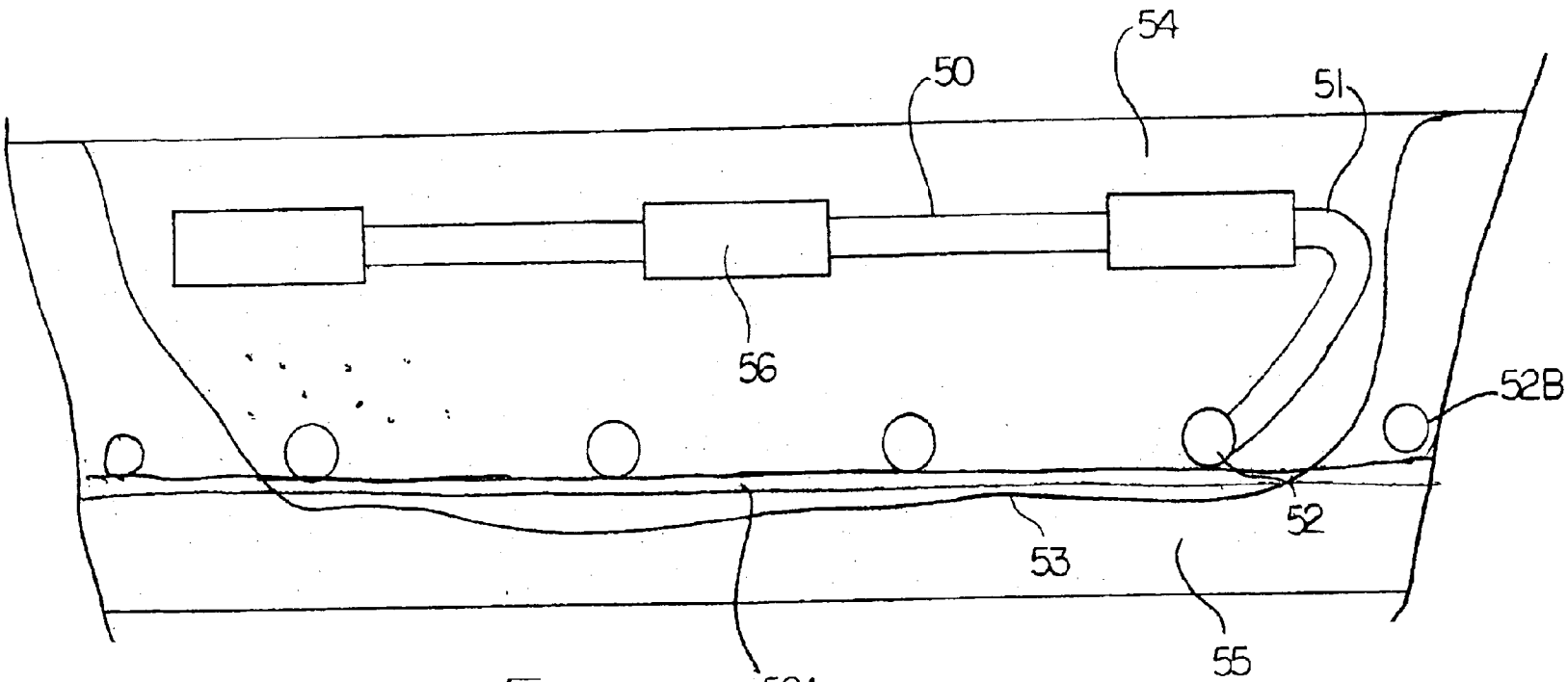
FIG. 2 is cross sectional view of one embodiment of an anode member including an anode array installed within an excavated patched area filled with fresh concrete which contains a cathodic corrosion inhibitor.

This arrangement has the advantage that the finished product is porous and that corrosion products from corrosion of the anode body during operation are received into the pores of the porous body and thus avoid any expansion of the anode body which could cause cracking of the concrete. This allows the surface of the anode body to lie in direct contact with the concrete either by embedding directly within the concrete, as shown in FIG. 2 or by insertion as a tight fit within a hole. In all such cases the amount of pores available allows the pressure from the expanded corrosion products to be absorbed within the anode body itself without the necessity for additional materials which act to absorb this pressure or without the modification of the concrete so as to accommodate the pressure.

This is particularly effective when combined with the arrangement shown herein where the body is embedded wholly within the concrete so as to be in direct contact with the concrete so as to communicate expansion forces, if any to the concrete. This formation of the anode body to define pores can be used without the addition into the anode body of the enhancement material. Thus the discrete anode body in porous form, if formed without the enhancement material will be formed wholly of the metallic anode material. The formation and the degree of compression can be selected to generate a porous structure with sufficient pore size and number per unit volume that the whole of the corrosion products is taken up into the pores thus avoiding any expansion of the body caused by the generation of the corrosion products. In addition this may allow the use of other materials such as aluminum or magnesium which are generally considered unsuitable because the corrosion products have a high increase in volume relative to the original metal thus causing severe cracking problems.

Alternatively the anode material can be in wire or foil form and crumpled and compressed to reduce the initially large voids to the required pore sizes to provide the pore volume described above.

The electrical connection from the anode material to the steel rebar is preferably provided by a material separate from the anode material itself such that its electrical connection is not lost or compromised during the corrosion of the anode. The connecting material is preferably steel.

Figure 3:
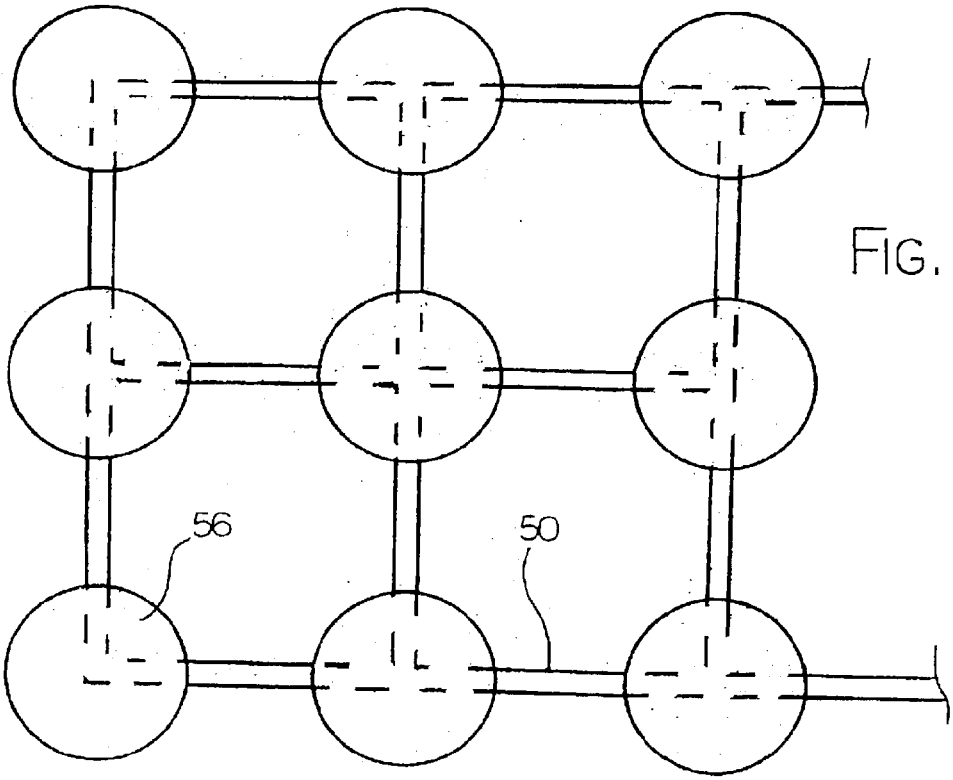
FIG. 3 is a top plan view of the array of FIG. 2.

Turning now to FIGS. 2 and 3 there is shown an arrangement of the anode body for use in a larger patch or for use in an overlay situation where the anode is inserted into a layer of concrete applied as an overlay over an existing or parent layer.

Thus in FIGS. 2 and 3 there is shown an array 50 of an electrical conductor specially formed of steel which is of a dimension sufficient to cover the required area of the patch or the required area of the overlay. One end of the steel wire array is provided as a connector 51 for connection to the steel 52 within the concrete layer.

As shown in FIG. 2 an excavation surface 53 is generated by a suitable excavation technique exposing some or all of the steel members 52 as indicated at 52A. The array 50 is then inserted into the area of the excavation and the array covered by an additional layer 54 of concrete, which may or may not be identical to the parent layer 55.

On the array 50 is attached a plurality of separate anode bodies 56 which are pressed in place onto the outside surface of the electrical conductor. Thus the conductor is formed of an integral internal structure within the anode body and provides the necessary electrical connection to the steel 52. The array 50 can be a grid as shown or can be formed from a mesh, ribbon or other structure which is shaped and arranged so as to be suitable for insertion into the area to be protected. A peripheral ribbon may be used around the exterior of a patch so that the electrical connector is in effect simply an elongate strip with anode bodies pressed into place at spaced positions along its length. This one dimensional array can then be inserted in place as required with one end connected to the steel. The two dimensional array shown in FIGS. 2 and 3 can also be used to more accurately locate the anode bodies at spaced positions across the full area to be protected.

Figure 4:
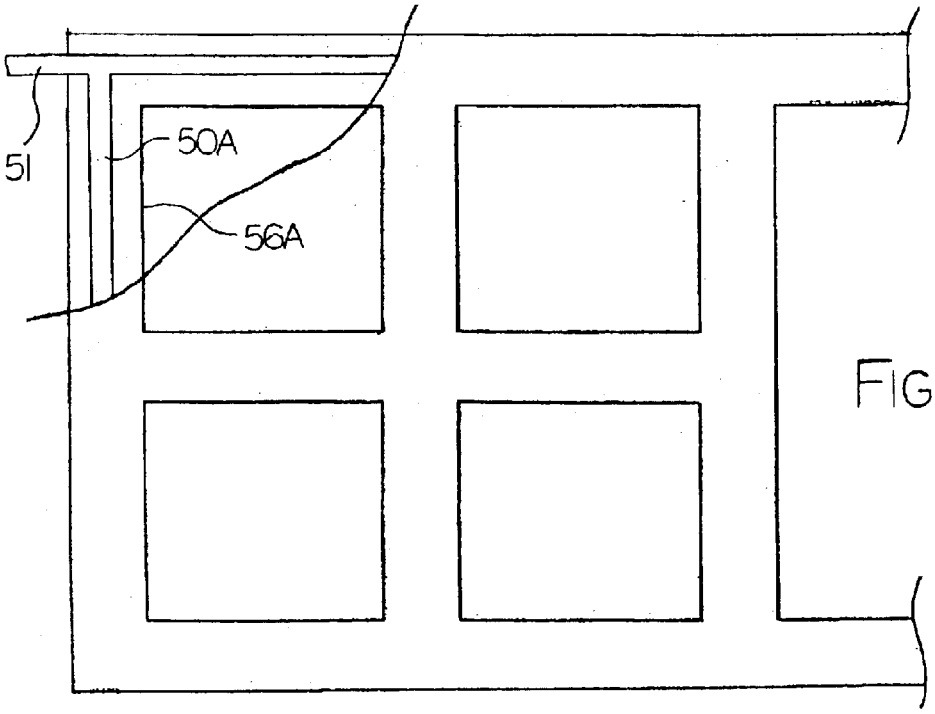
FIG. 4 is a top plan view of an alternative array for use in the patched area of FIG. 2.

In a further alternative arrangement as shown in FIG. 4, the electrical conductive wire 50A is covered substantially over its whole construction by the anode body 56A. Thus in FIG. 3 the anode bodies of a larger dimension for example in the form of discs or pucks. However in FIG. 4, the anode body forms an elongate shape surrounding the whole of the length of the wire which can be of any suitable cross section such as square or round as required. One end 51 is left exposed for connection to the steel 52.

In an alternative arrangement (not shown), the anode array can be covered or buried in a covering layer which is applied onto an existing layer of concrete. Thus the anode may be only partly buried in the original concrete or may be wholly outside the original concrete and thus may be covered by the new concrete applied. In this way, in some cases, no excavation or minimal excavation of the original material may be necessary. The additional concrete can be applied by attaching a suitable form, for example a jacket similar to that shown in U.S. Pat. No. 5714,045 (Lasa et al) issued Feb. 3$^{rd}$ 1998. The form shown in this patent is particularly designed for columns but other arrangements could be designed for other structures. The anode shown in this patent is replaced by the anodes disclosed hereinafter. The forms can be left in place or can be removed.

The array can also be used to provide structural strength. Thus where additional reinforcement is required, for example when the existing steel reinforcement has corroded or where reinforcement is required in an overlay, the array itself can provide the dual function of the anodes for protection of the existing steel and the structural reinforcement of the concrete. This is particularly related to the arrangement where a steel mesh, grid or core is provided and covered partially or wholly by the anode material or anode bodies.

Also the present invention is primarily concerned with concrete structures but some aspects, such as the anode construction, can also be used with other situations where a steel element is buried within a covering layer. The above description is directed to the primary use, but not sole use, with concrete structures.

The cathodic protection device therefore operates to form an electrolytic potential difference between the anode and the steel reinforcing member which causes a current to flow therebetween through the electrical connection and causes ions to flow therebetween through the concrete sufficient to prevent or at least reduce corrosion of the steel reinforcing bar while causing corrosion of the anode.

The level of the pH and the presence of the humectant enhances the maintenance of the current so that the current can be maintained for an extended period of time for example in a range 5 to 20 years.

The presence of the humectant material bound into the anode body acts to absorb sufficient moisture to maintain ion transfer around the anode to ensure that sufficient output current is maintained during the life of the anode and to keep the anode/filler interface electrochemically active. The presence also increases the amount of the current.

The anode can be formed of any suitable material which is electronegative relative to the steel reinforcing members. Zinc is the preferred choice, but other materials such as magnesium, aluminum or alloys thereof can also be used.

This arrangement of providing the agent directly in the anode body allows the construction of an anode body which is of minimum dimensions thus allowing its installation in smaller locations or holes and thus allowing installation in locations where space is limited and thus reducing costs for forming the excavation to allow the installation.

In accordance with the features disclosed in this application, a corrosion inhibitor is added to the concrete to restrict the flow of ionic current to the steel within the fresh concrete without substantially increasing the resistivity of the concrete and without substantially inhibiting the ability of the anode to put out current.

Various types of corrosion inhibitor can provide the following features. The inhibitor reduces the flow of galvanic current to the steel within the repair so as to increase the proportion of the current percentage which flows to the steel outside the repair. The addition of the inhibitor does not substantially increase the resistivity of the repair concrete. The addition maintains the electrical properties of the repair concrete so that it does not inhibit the embedded anode from functioning properly.

The inhibitor can be added to the bulk of the new concrete. The inhibitor can be added directly around the steel in the repair area. The preferred method will depend on geometry, costs, concrete properties, steel quantity, and type of inhibitor used. The inhibitor can be of the following types:

Aliphatic and Aromatic Nitrogen compounds—such as:

Amine based compounds

Amino alcohol

Amino carboxylate

Amine epoxy

Amide based compounds

Azole compounds

Imine based compounds

Imide based compounds

Aliphatic and Aromatic Phosphorous compounds—such as:

Phosphonate compounds

Phosphonium compounds

Calcium Nitrite which is a commonly used corrosion inhibitor does not work because it affects the output of the anode if it is in direct contact therewith and it does not limit the ionic current to the steel material in the fresh concrete.

Surprisingly, the corrosion inhibitors as defined above have the effect of reducing the current going to the steel (in the patch) but do not adversely affect the ability of the anode to put out current to the steel outside the repair in the existing concrete.

Thus the corrosion inhibitors which are applied into the fresh concrete act to inhibit the ionic current to the steel within the fresh concrete while maintaining the current capacity of the anode so that a greater proportion or ratio of the current is transmitted to the existing steel within the existing concrete. This inhibiting effect applies not only to the reinforcing or structural steel within the fresh concrete but also to the steel material provided as electrical connections between the anode bodies and the reinforcing steel. It will of course be appreciated that, in the absence of the material which inhibits the current to the steel in the fresh concrete, a higher level of current would flow to that steel and thus act to reduce corrosion of the steel in the fresh concrete and unnecessarily reduce the service life of the anodes. However the primary intention is to reduce corrosion to the existing steel which, in this situation, will have been in existence for many years so that the corrosion will already have commenced. The steel in the fresh concrete thus requires little attention at this time and thus the present invention provides a technique by which the cathodic protection effect to the steel in the fresh concrete is reduced or minimized while the effect is maximized to the other existing steel.

In the embodiment described above, this is surprisingly achieved by applying a selected corrosion inhibitor material into the fresh concrete and at the time embedding the anode member or anode members within the fresh concrete. The selected corrosion inhibitor surprisingly does not inhibit the communication of current from the anode as a whole but instead directs it to the primary location that is the steel in the existing concrete.

In FIG. 2 it will be noted that the steel 52 within the excavated patch is electrically connected by a connection 52A to the steel 52B within the existing concrete. The connection 51 thus supplies the electrical connection necessary for the electrical current between the steel and the anode member to balance the ionic current communicated between the steel and the anode member, regardless of those areas of the steel from which the current primarily flows. The electrical connection between the steel is shown only schematically.

Figure 5:
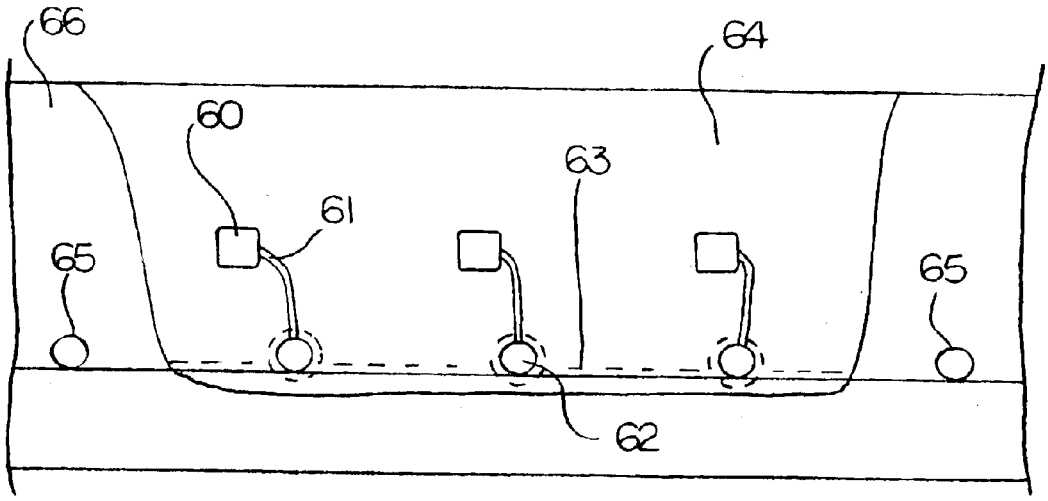
FIG. 5 is a cross sectional view of a second embodiment of a plurality of anode members installed within an excavated patched area filled with fresh concrete where the steel in the fresh concrete is covered by a coating which inhibits ionic current thereto.

In FIG. 5 is shown an alternative arrangement in which the anode member is formed not as an array but as a plurality of individual anode bodies 60, each of which has its own electrical connection 61 to the steel reinforcement array within the structure.

Thus again in the arrangement of FIG. 5, the ionic current from the anode bodies is maximized to existing steel 65 and is minimized to the steel within the fresh concrete. In the embodiment of FIG. 5 the steel within the fresh concrete is of course the existing steel and there is no additional steel applied but because that existing steel within the fresh concrete is in communication with fresh concrete, its tendency to corrode is thus significantly reduced and current is not required to protect it.

Figure 6:
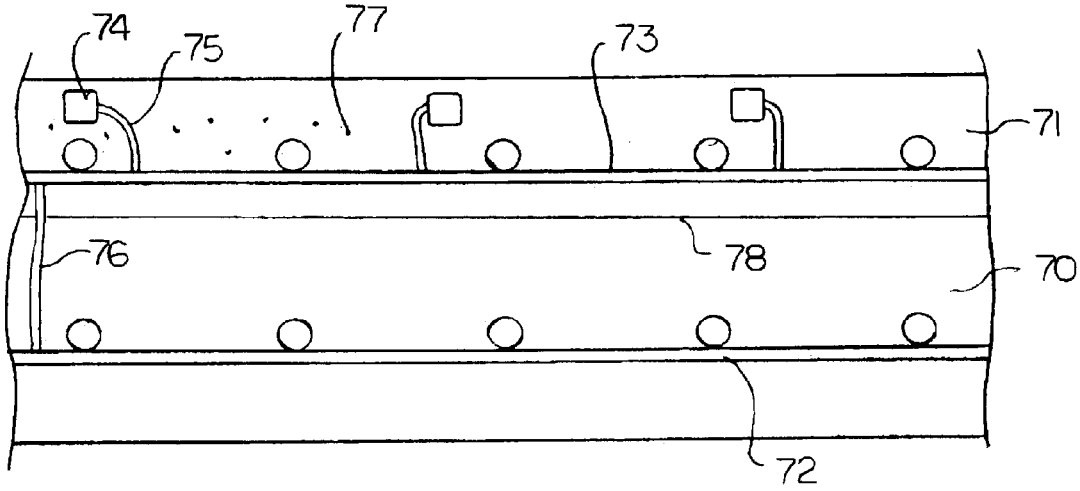
FIG. 6 is a cross sectional view of a third embodiment of a plurality of anode members installed within an overlay of fresh concrete where the fresh concrete contains a cathodic corrosion inhibitor.

In FIG. 6 is shown a further arrangement in which there is an existing layer 70 of existing concrete onto which is applied an overlay or coating or covering 71 of an additional layer of concrete. The existing concrete includes existing steel 72. The overlay 71 includes fresh steel 73 which is applied into the overlay for reinforcement thereof. Individual anode members 74 are embedded within the overlay 71 or alternatively an array (not shown) of an anode member can be applied into the overlay 71. The anode members or the array are electrically connected by connections 75 to the fresh steel 73 and there is also provided a connection 76 between the fresh steel and the existing steel to provide electrical connection therebetween. Again the corrosion inhibitor material 77 is applied into the fresh concrete so as to inhibit the ionic current from the fresh steel and thus maximize the ionic current to the existing steel 72 in the existing concrete. The ionic current passes through an interface 78 between the existing concrete 70 and the overlay 71. Thus, even though the anode members are much closer to the fresh steel than the existing steel, the required protection to the existing steel is maximized. Although this embodiment uses the corrosion inhibitor within the concrete of the overlay, other methods for restricting the ionic flow from the steel within the fresh concrete can be used as described herein.

Figure 7:
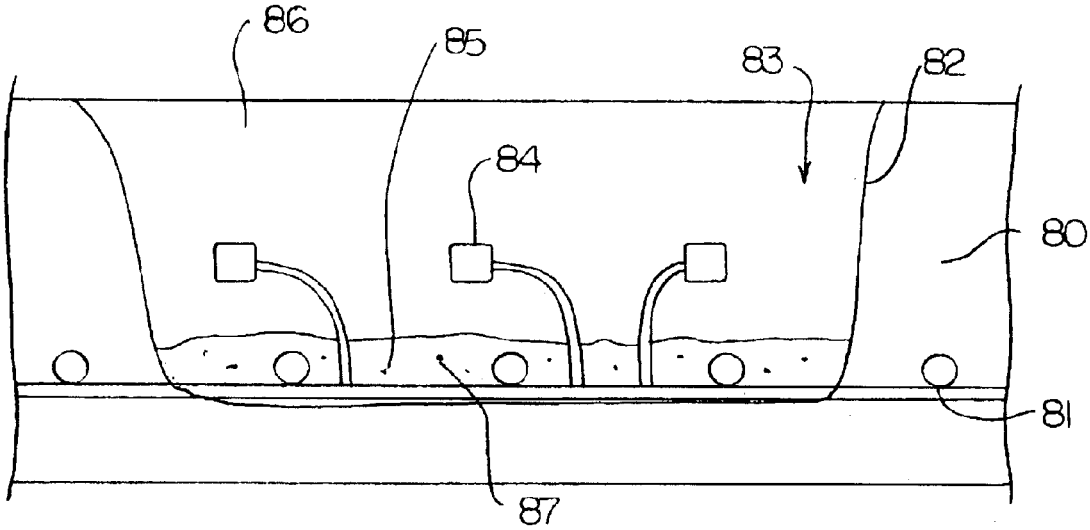
FIG. 7 is a cross sectional view of a fourth embodiment of a plurality of anode members installed within an excavated patch area filled with fresh concrete where an initial portion of the fresh concrete surrounding the steel contains a corrosion inhibitor.

Turning now to FIG. 7, there is shown an arrangement similar to that of FIG. 2 and FIG. 5 including an existing concrete structure including a concrete layer 80 with existing steel 81 and a patch 82 within which is applied fresh concrete 83. The anode members 84 are located within the fresh concrete and are electrically connected to the existing steel 81. In this embodiment, the fresh concrete includes a first portion 85 and a second portion 86. The first portion is applied over the existing steel 81 so as to provide a covering therefor and includes the corrosion inhibitor material 87 for cooperating with the steel and particularly to provide an interface between the steel and the concrete portion 85 which inhibits the ionic current to the existing steel within the fresh concrete. Thus the remainder of the concrete provided by the portion 86 can be free from the corrosion inhibitor.

Figure 8:
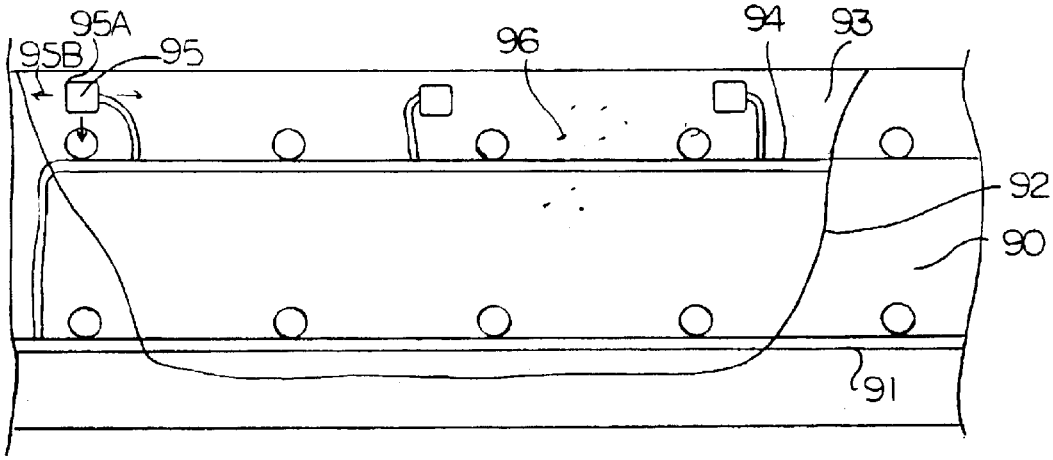
FIG. 8 is a cross sectional view of one embodiment of a plurality of anode members installed within an excavated patch area filled with fresh concrete which contains a corrosion inhibitor and including additional reinforcing steel within the fresh concrete.
Figure 9:
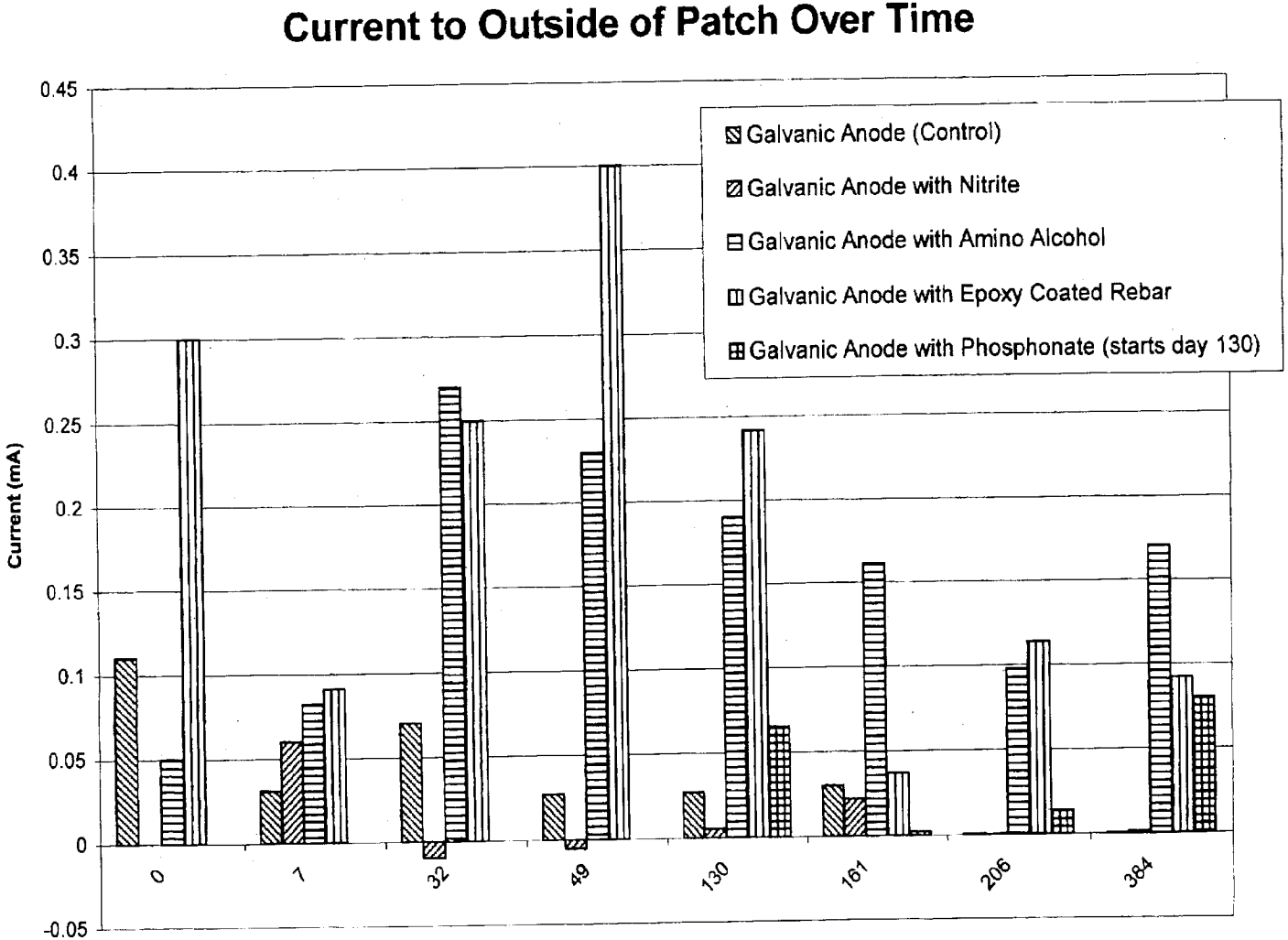
FIG. 9 is a table showing the current value in the area outside the patch for a number of trials of different arrangements of cathodic protection arrangements over a number of days of operation.

In FIG. 8 is shown a further embodiment in which there is an existing layer 90 of concrete with existing steel 91. A patch 92 is filled with a further layer 93 of fresh concrete. In this embodiment additional steel 94 is provided to supplement the existing steel 91 either due to a change in engineering requirement or due to corrosion which has caused weakening of the existing steel 91. The anode bodies 95 are electrically connected to the fresh steel 94 which is itself electrically connected to the existing steel 91. The corrosion inhibiting material 95A is contained in the anode body itself for diffusion from the anode body over time to enter the fresh concrete 93 and thus inhibit the ionic current from the existing steel and from the fresh steel within the fresh concrete thus maximizing the ionic current to the existing steel 91 within the existing concrete 90. The corrosion inhibiting material may be introduced onto the anode body as a liquid to be carried thereby when the anode body is installed in the fresh concrete. The liquid may be contained in the anode material itself or in a coating such as mortar surrounding the anode material.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method for cathodic protection comprising:

providing steel material;

providing a covering material such that at least a part of the steel material is covered by the covering material;

forming a cathodic protection combination by:

providing at least one anode member;

arranging the at least one anode member in connection with the covering material for communication of ions therebetween;

and electrically connecting the at least one anode member so that an electrical potential between the anode member and the steel material causes ions to flow through the covering material tending to inhibit corrosion of the steel material;

and applying into the combination a current inhibiting material of a character arranged to reduce communication of ions to the steel material in the covering material.

2. The method according to claim 1 wherein the current inhibiting material is applied into the covering material.

3. The method according to claim 2 wherein the current inhibiting material is applied into the covering material at the interface with the steel material therein.

4. The method according to claim 1 wherein the current inhibiting material is applied into the covering material in admixture therewith.

5. The method according to claim 1 wherein the current inhibiting material is in contact with the surface of the anode.

6. The method according to claim 1 wherein the current inhibiting material is of a character which avoids inhibiting the ability of the anode member to generate an ionic current between the anode member and the covering material.

7. The method according to claim 1 wherein the current inhibiting material is of a character which avoids significantly increasing the resistivity of the covering material.

8. The method according to claim 1 wherein the current inhibiting material is carried by the anode member when it is embedded in the covering material for diffusion from the anode member into the covering material.

9. The method according to claim 1 wherein the anode member is embedded in the covering material.

10. The method according to claim 1 wherein the anode member is formed at least partly of sacrificial anode material which is compressed from an initial condition to form a porous structure.

11. The method according to claim 1 wherein the anode member includes admixed therewith an enhancement material for co-operating with the sacrificial anode material in enhancing the communication of ions between the covering material and the anode material.

12. The method according to claim 1 wherein the anode member comprises an electrically conductive array which is at least partly formed by said anode material.

13. The method according to claim 1 wherein the covering material is a fresh covering material applied to an existing covering material and wherein the steel material extends both within the existing covering material and the fresh covering material.

14. The method according to claim 13 wherein the current inhibiting material is arranged to act on that part of the steel material within the fresh covering material.

15. The method according to claim 1 wherein the current inhibiting material is of a character which is a cathodic corrosion inhibitor.

16. A method for cathodic protection comprising:

providing an existing structure including an existing covering material;

providing steel material;

applying a fresh covering material to the existing structure such that a part of the steel material is at least partly covered by the existing covering material and a part of the steel material is at least partly covered by the fresh covering material;

providing at least one anode member;

arranging the at least one anode member in connection with the fresh covering material for communication of ions therebetween;

electrically connecting the at least one anode member so that an electrical potential between the anode member and the steel material causes ions to flow through the covering material tending to inhibit corrosion of the steel material;

and increasing the ratio of ionic current from the anode member to the steel material within the existing covering material by reducing the flow of ionic current between the anode member and the steel material within the fresh covering material.

17. The method according to claim 16 wherein the flow of ionic current between the anode member and the steel material within the fresh covering material is reduced by providing a current inhibiting material which inhibits the communication of ionic current through the interface between the fresh covering material and the steel material therein.

18. The method according to claim 17 wherein the current inhibiting material is arranged so that it is in use in admixture with the fresh covering material.

19. The method according to claim 17 wherein the current inhibiting material is carried by the anode member when it is embedded in the fresh covering material for diffusion from the anode member into the fresh covering material.

20. The method according to claim 17 wherein the current inhibiting material is of a character which is a cathodic corrosion inhibitor.

21. The method according to claim 17 wherein the current inhibiting material is selected from the group consisting of aliphatic and aromatic nitrogen compounds and aliphatic and aromatic phosphorous compounds.

22. The method according to claim 17 wherein the current inhibiting material is in contact with the surface of the anode member.

23. The method according to claim 17 wherein the current inhibiting material is of a character which avoids inhibiting the ability of the anode member to generate an ionic current between the anode member and the covering material.

24. The method according to claim 17 wherein the current inhibiting material is of a character which avoids significantly increasing the resistivity of the fresh covering material.

25. The method according to claim 16 wherein the anode member is embedded in the fresh covering material.

26. The method according to claim 16 wherein the anode member is formed at least partly of sacrificial anode material which is compressed from an initial condition to form a porous structure.

27. The method according to claim 16 wherein the anode member includes admixed therewith an enhancement material for co-operating with the sacrificial anode material in enhancing the communication of ions between the covering layer and the anode material.

28. The method according to claim 16 wherein the anode member comprises an electrically conductive array which is at least partly formed by a sacrificial anode material.

29. A method for cathodic protection comprising:

providing an existing structure including an existing covering material;

providing steel material;

applying a fresh covering material to the existing structure such that at least part of the steel material is at least partly covered by the existing covering material and at least part of the steel material is at least partly covered by the fresh covering material;

providing at least one anode member;

arranging the at least one anode member in connection with the fresh covering material for communication of ions therebetween;

electrically connecting the at least one anode member so that an electrical potential between the anode member and the steel material causes ions to flow through the covering material tending to inhibit corrosion of the steel material;

and applying into the fresh covering material at least at the interface with the steel material therein a current inhibiting material of a character which reduces the flow of ionic current between the steel material and the fresh covering material without substantially increasing the resistivity of the fresh covering material and without substantially inhibiting the flow of ionic current between the anode member and the fresh covering material.

30. The method according to claim 29 wherein the current inhibiting material is arranged so that it is in use in admixture with the fresh covering material.

31. The method according to claim 29 wherein the current inhibiting material is carried by the anode member when it is embedded in the covering material for diffusion from the anode member into the covering material.

32. The method according to claim 29 wherein the current inhibiting material is of a character which is a cathodic corrosion inhibitor.

33. The method according to claim 29 wherein the current inhibiting material is in contact with the surface of the anode member.

34. The method according to claim 29 wherein the current inhibiting material is selected from the group consisting of aliphatic and aromatic nitrogen compounds and aliphatic and aromatic phosphorous compounds.

35. The method according to claim 29 wherein the current inhibiting material is of a character which avoids inhibiting the ability of the anode member to generate an ionic current between the anode member and the covering material.

36. The method according to claim 29 wherein the anode member is embedded in the fresh covering material.

37. The method according to claim 29 wherein the current inhibiting material is of a character which avoids significantly increasing the resistivity of the fresh covering material.

38. The method according to claim 29 wherein the anode member is formed at least partly of sacrificial anode material which is compressed from an initial condition to form a porous structure.

39. The method according to claim 29 wherein the anode member includes admixed therewith an enhancement material for co-operating with the sacrificial anode material in enhancing the communication of ions between the covering layer and the anode material.

40. The method according to claim 29 wherein the anode member comprises an electrically conductive array which is at least partly formed by a sacrificial anode material.

41. A method for cathodic protection comprising:

providing steel material;

providing a covering material such that at least a part of the steel material is covered by the covering material;

forming a cathodic protection combination by:

providing at least one anode member;

arranging the at least one anode member in connection with the covering material for communication of ions therebetween;

and electrically connecting the at least one anode member so that an electrical potential between the anode member and the steel material causes ions to flow through the covering material tending to inhibit corrosion of the steel material;

and applying into the combination a current inhibiting material;

wherein the current inhibiting material is selected from the group consisting of aliphatic and aromatic nitrogen compounds and aliphatic and aromatic phosphorous compounds.

* * * * *